US006027414A

United States Patent [19]

Koebler

[11] Patent Number: 6,027,414

[45] Date of Patent: Feb. 22, 2000

[54] GOLF CLUB WITH AERODYNAMIC SHAFT AND HEAD

[76] Inventor: Martin Koebler, 1885 California St. #5, Mountain View, Calif. 94041

[21] Appl. No.: 09/165,273

[22] Filed: Oct. 1, 1998

[51] Int. Cl.[7] ..... A63B 69/36; A63B 53/10; A63B 53/12; A63B 53/04

[52] U.S. Cl. ..... 473/228; 473/317; 473/327

[58] Field of Search ..... 473/228, 317, 473/327, 328

[56] References Cited

U.S. PATENT DOCUMENTS

| | | |
|---|---|---|
| 3,595,577 | 7/1971 | Hodge . |
| 5,050,884 | 9/1991 | Flory . |
| 5,054,784 | 10/1991 | Collins . |
| 5,190,289 | 3/1993 | Nagai . |
| 5,251,896 | 10/1993 | Gerlach . |
| 5,335,908 | 8/1994 | Bamber . |
| 5,393,581 | 2/1995 | Mares . |
| 5,415,406 | 5/1995 | Reichenbach . |
| 5,588,921 | 12/1996 | Parsick . |
| 5,632,692 | 5/1997 | Lebovici . |
| 5,681,227 | 10/1997 | Sayrizi . |
| 5,735,752 | 4/1998 | Antonious . |
| 5,873,793 | 2/1999 | Swinford . |
| 5,921,870 | 7/1999 | Chiasson . |

*Primary Examiner*—Sebastiano Passaniti
*Attorney, Agent, or Firm*—Jay R Beyer

[57] ABSTRACT

A golf club shaft connects a grip of a golf club to a head of the golf club and has a longitudinal axis that extends from the grip of the golf club to the head of the golf club. At least a portion of the shaft has an aerodynamic cross-sectional shape defining an aerodynamic portion of the shaft. The aerodynamic portion of the shaft is oriented along at least a portion of the longitudinal axis of the shaft. The aerodynamic portion of the shaft is oriented relative to the grip and the head such that, compared to a gulf club shaft having a circular cross-sectional shape, the aerodynamic portion of the shaft is able to improve the stability of the shaft as the golf club is swung through the air in a particular with the head oriented to squarely strike a golf ball. The aerodynamic portion of the shaft may be integrally formed as part of the golf club shaft. Alternatively, the aerodynamic portion of the shaft may be by as a separate aerodynamic fin that may be attached to a conventional golf club shaft. In another aspect of the invention, a golf club head includes a striking surface having a plurality of openings formed into the striking surface. The openings extend through the head thereby allowing air to pass through the openings when the golf club is swung in the certain manner.

4 Claims, 3 Drawing Sheets

GOLF CLUB WITH AERODYNAMIC SHAFT AND HEAD

BACKGROUND OF THE INVENTION

The present invention relates generally to golf clubs and more specifically to arrangements for providing golf clubs that are aerodynamically stabilized as they are swung through the air to strike a golf ball.

Although golf clubs are continuously being improved to provide golfers better performance and control, certain aspects of golf club designs have room for further improvement. One of the areas in which golf clubs may be further improved is in the area of providing a golf club shaft and head that improve the stability of the shaft and head while the golf club is swung.

In a conventional golf club such as a conventional driver, the head typically has a relatively large, flat striking surface that is the leading surface of the head as the golf club is swung through the air to strike a golf ball. This large, flat striking surface creates an aerodynamic drag that can cause vibrations or twisting oscillations within the golf club shaft. Also, a substantial percentage of the weight of the golf club is typically located in the head of the club. This concentration of the weight in the golf club head may contribute to or amplify the vibrations or twisting oscillations. These vibrations or twisting oscillations can cause the striking surface of the head to be slightly out of proper alignment when the striking surface of the golf club head strikes the golf ball resulting in reduced directional control. The present invention provides an aerodynamically stabilized golf club that stabilizes the golf club shaft and head as the golf club is swung through the air.

SUMMARY OF THE INVENTION

As will be described in more detail hereinafter, a golf club having an aerodynamic shaft is disclosed. The golf club has a grip and a head with the shaft connecting the grip of the golf club to the head of the golf club. The shaft has a longitudinal axis that extends from the grip of the golf club to the head of the golf club. In accordance with the invention, at least a portion of the shaft has an aerodynamic cross-sectional shape defining an aerodynamic portion of the shaft. The aerodynamic portion of the shaft is oriented along at least a portion of the longitudinal axis of the shaft. The aerodynamic portion of the shaft is oriented relative to the grip and the head such that, compared to a gulf club shaft having a circular cross-sectional shape, the aerodynamic portion of the shaft is able to improve the stability and/or reduce the aerodynamic drag of the shaft as the golf club is swung through the air in a particular manner with the head oriented to squarely strike a golf ball.

In one embodiment, the aerodynamic portion of the shaft extends substantially from the grip of the golf club to the head of the golf club. The aerodynamic cross-section shape of the shaft may be a cross-sectional shape selected from the group of shapes including a foil shape, an elliptical shape, an oval shape, an egg shape, a rectangular shape having rounded corners, a rectangular shape having beveled corners, and an elongated polygon shape. Furthermore, the surface of the aerodynamic portion of the shaft may have a surface finish selected from the group of finishes including a polished finish, a smooth painted finish, a waxed finish, a dimpled finish, and a textured finish in order to reduce the aerodynamic drag of the aerodynamic portion of the shaft.

In another embodiment, the aerodynamic portion of the shaft has a leading edge and a trailing edge. The trailing edge of the aerodynamic portion of the shaft has at least one slot cut into the trailing edge of the aerodynamic portion of the shaft in order to allow the shaft to more easily flex along the longitudinal axis of the shaft in the plane formed by the leading edge and the trailing edge of the aerodynamic portion of the shaft. Alternatively, the leading edge of the aerodynamic portion of the shaft may have at least one slot cut into the leading edge of the aerodynamic portion of the shaft in order to allow the shaft to more easily flex along the longitudinal axis of the shaft in the plane formed by the leading edge and the trailing edge of the aerodynamic portion of the shaft.

In another embodiment, an aerodynamic fin for use on a golf club having a golf club grip, a head, and a shaft with a longitudinal axis that extends from the golf club grip to the head of the golf club is disclosed. The aerodynamic fin includes a main body having a longitudinal axis and an aerodynamic cross-sectional shape extending along the longitudinal axis of the main body. The aerodynamic fin also includes an attaching arrangement for attaching the aerodynamic fin to the golf club shaft along the longitudinal axis of the golf club shaft. The aerodynamic fin is oriented relative to the grip and the head of the golf club such that, compared to a gulf club without the aerodynamic fin, the aerodynamic fin is able to improve the stability of the shaft of the golf club as the golf club is swung through the air in a particular manner with the head oriented to squarely strike a golf ball.

In one version of the aerodynamic fin, the aerodynamic fin is configured to extend substantially from the grip of the golf club to the head of the golf club when the aerodynamic fin is attached to the golf club. The aerodynamic cross-section shape of the aerodynamic fin may be a cross-sectional shape selected from the group of shapes including a foil shape, an elliptical shape, an oval shape, an egg shape, a rectangular shape having rounded comers, a rectangular shape having beveled corners, and an elongated polygon shape. Additionally the aerodynamic fin may have a surface finish selected from the group of finishes including a polished finish, a smooth painted finish, a waxed finish, a dimpled finish, and a textured finish in order to reduce the aerodynamic drag of the aerodynamic fin.

In another version of the aerodynamic fin, the aerodynamic fin has a leading edge and a trailing edge. The trailing edge of the aerodynamic fin has at least one slot cut into the trailing edge of the aerodynamic fin in order to allow the golf club shaft to more easily flex along the longitudinal axis of the golf club shaft in the plane formed by the leading edge and the trailing edge of the aerodynamic fin when the aerodynamic fin is attached to the golf club. Alternatively, the aerodynamic fin may have at least one slot cut into the leading edge of the aerodynamic fin in order to allow the golf club shaft to more easily flex along the longitudinal axis of the shaft in the plane formed by the leading edge and the trailing edge of the aerodynamic fin when the fin is attached to the golf club shaft.

A golf club head for use on a golf club having a golf club shaft is also disclosed. The gulf club head includes an overall aerodynamically shaped main body having a striking surface and an attaching arrangement for attaching the golf club head to the golf club shaft. The striking surface of the main body of the golf club head is oriented such that the striking surface may be used to strike a golf ball when the head is attached to the golf club shaft and the golf club is swung in a certain manner. The striking surface of the main body defines an overall striking surface area. The overall aerodynamically shaped main body has a plurality of openings formed into the striking surface of the main body of the golf club head. The openings extended through the main body of the golf club head thereby allowing air to pass through the openings when the golf club is swung in the certain manner.

In one version of the golf club head, the combined area of the openings formed into the striking surface is a substantial percentage of the striking surface area. For example, the combine area of the openings formed into the striking surface may be greater than 50 percent of the overall striking surface area. In another version of the golf club head, the plurality of openings take the form of a plurality of generally square openings thereby creating a grid pattern on the striking surface of the main body of the golf club head. Alternatively, the plurality of openings may take the form of a plurality of slots formed in to the striking surface and extending through the main body of the golf club head.

BRIEF DESCRIPTION OF THE DRAWINGS

The features of the present invention may best be understood by reference to the following description of the presently preferred embodiments together with the accompanying drawings in which.

DETAILED DESCRIPTION OF THE PREFERRED EMBODIMENTS

An invention is described for providing an aerodynamic golf club shaft and head. In the following description, numerous specific details are set forth in order to provide a thorough understanding of the present invention. It will be obvious, however, to one skilled in the art, that the present invention may be embodied in a wide variety of specific configurations. Also, well known processes have not been described in detail in order not to unnecessarily obscure the present invention.

Figure 1:
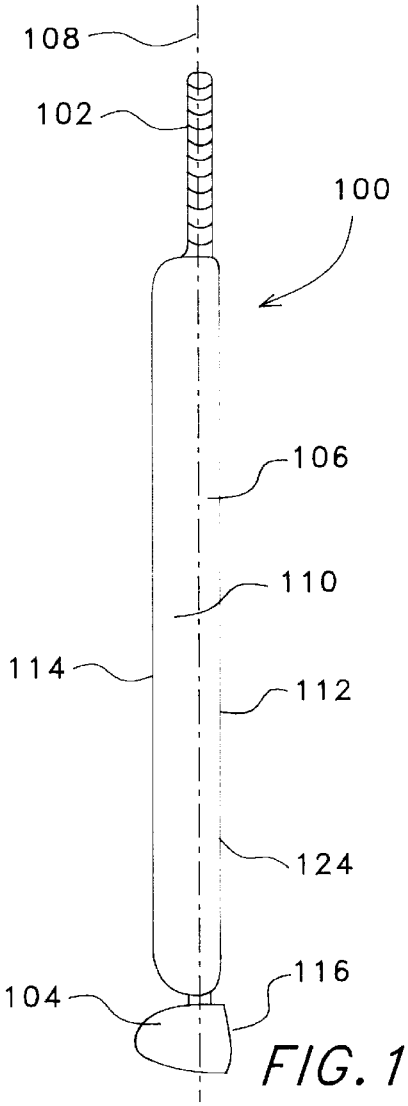
FIG. 1 is a diagrammatic side view of a first embodiment of a golf club designed in accordance with the present invention.

Turning to the drawings, wherein like components are designated by like reference numerals throughout the various figures, attention is initially directed to FIG. 1. This figure illustrates a first embodiment of a golf club 100 designed in accordance with the invention. Golf club 100 has a grip 102 and a head 104 with a shaft 106 connecting grip 102 of golf club 100 to head 104 of the golf club. Shaft 106 has a longitudinal axis 108 that extends from grip 102 of golf club 100 to head 104 of golf club 100. In accordance with the invention, at least a portion of shaft 106 has an aerodynamic cross-sectional shape defining an aerodynamic portion 110 of the shaft. Aerodynamic portion 110 of shaft 106 is oriented along at least a portion of longitudinal axis 108 of shaft 106 and includes a leading edge 112 and a trailing edge 114.

Figure 2A:
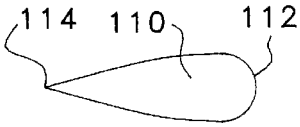
FIGS. 2A–G illustrate various possible cross sectional shapes for an aerodynamic shaft of a golf club designed in accordance with the invention.
Figure 2B:
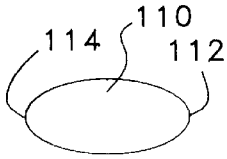
Figure 2C:
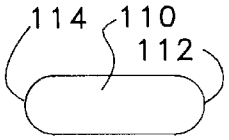
Figure 2D:
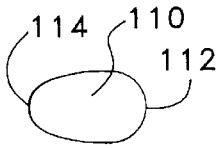
Figure 2E:
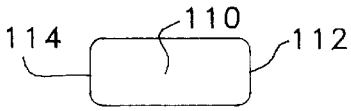
Figure 2F:
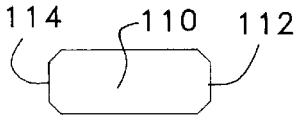
Figure 2G:
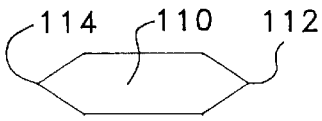

As illustrated in FIG. 2A, aerodynamic portion 110 of shaft 106 preferably has a foil shaped cross sectional shape. However, it should be understood that the invention is not limited to this particular cross sectional shape. Instead, the cross sectional shape of aerodynamic portion 110 of shaft 106 may be any cross sectional shape so long as it provides an improved aerodynamic shape compared to a conventional circular cross sectional shaped golf club shaft. FIGS. 2B–G illustrate some examples of alternative possible aerodynamic cross sections for aerodynamic portion 110. These shapes include, but are not limited to, an elliptical shape, an oval shape, an egg shape, a rectangular shape having rounded corners, a rectangular shape having beveled corners, and an elongated polygon shape all of which are respectively shown in FIGS. 2B–G.

Head 104 of club 100 includes a striking surface 116 for striking a golf ball when golf club 100 is swung through a plane generally defined by the plane running through leading edge 112 and trailing edge 114 of aerodynamic portion 110 of shaft 106. Striking surface 116 generally defines a plane perpendicular to the plane running through leading edge 112 and trailing edge 114. In accordance with the invention, aerodynamic portion 110 of shaft 106 is oriented such that, compared to a gulf club shaft having a circular cross-sectional shape, shaft 106 is able to improve the stability of shaft 106 and head 104 as the golf club is swung through the air to strike a golf ball. That is, when golf club 100 is swung through a plane generally defined by the plane running through leading edge 112 and trailing edge 114 of aerodynamic portion 110 of shaft 106, the flow of air around aerodynamic portion 110 of shaft 106 helps to stabilize shaft 106 by reducing the vibrations or twisting oscillations in shaft 106.

When properly configured, aerodynamic portion 110 of shaft 106 also reduces the aerodynamic drag caused by shaft 106 as club 100 is swung through the air when compared to a conventional golf club using a circular cross sectional shaft. For example, if a foil shaped cross section is used as illustrated in FIG. 2A, and the thickness of the foil is no greater than the diameter of the circular cross sectional shaft of the conventional golf club, then the aerodynamic drag caused by the shaft including the foil shaped aerodynamic portion will typically be less than the aerodynamic drag caused by the conventional circular cross sectional shaft.

Figure 3:
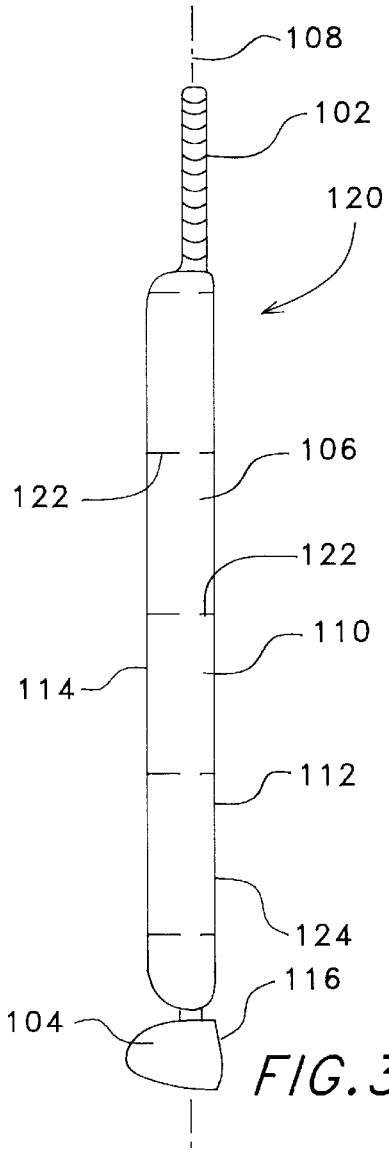
FIG. 3 is a diagrammatic side view of a second embodiment of a golf club designed in accordance with the present invention.

Referring now to FIG. 3, another embodiment of a golf club 120 will be described. As described above for club 100, club 120 includes grip 102, head 104, shaft 106 that extends along axis 108, and aerodynamic portion 110 with leading edge 112 and trailing edge 114. Club 120 also includes striking surface 116 for striking a golf ball when club 120 is swung through a plane defined by the plane extending through leading edge 112 and trailing edge 114. However, in this embodiment, trailing edge 114 and leading edge 112 of aerodynamic portion 110 of shaft 106 have slots 122 cut into leading edge 112 and trailing edge 114. These slots allow shaft 106 to flex more easily within the plane defined by leading edge 112 and trailing edge 114. In some cases, this flexing of shaft 106 within the plane defined by leading edge 112 and trailing edge 114 may be desirable in order to provide a more natural feel as the golf club is swung.

Although slots 122 are described as being formed into both leading edge 112 and trailing edge 114, this is not a requirement. Instead, the slots may be formed into only the leading edge or only the trailing edge. Also, although five slots are shown on both the leading edge and the trailing edge of club 120, this is also not a requirement of the invention. Instead, any number of slots may be utilized in order to provide the desired amount of flex in the plane defined by leading edge 112 and trailing edge 114.

To further reduce the aerodynamic drag of the aerodynamic portion 110 of clubs 100 and 120, the surface of aerodynamic portion 110 of the shaft may be finished with a low drag surface finish 124. This low drag finish may include, but is not limited to, a polished finish, a smooth painted finish, a waxed finish, a dimpled finish, and a textured finish. These finishes may be applied in any conventional.

Although the aerodynamic portion of shaft 106 has been described as being formed as part of shaft 106, this is not a requirement of the invention. Instead, the aerodynamic portion of the shaft may be provided as a separate aerodynamic fin that is attached to the golf club shaft.

Figure 4:
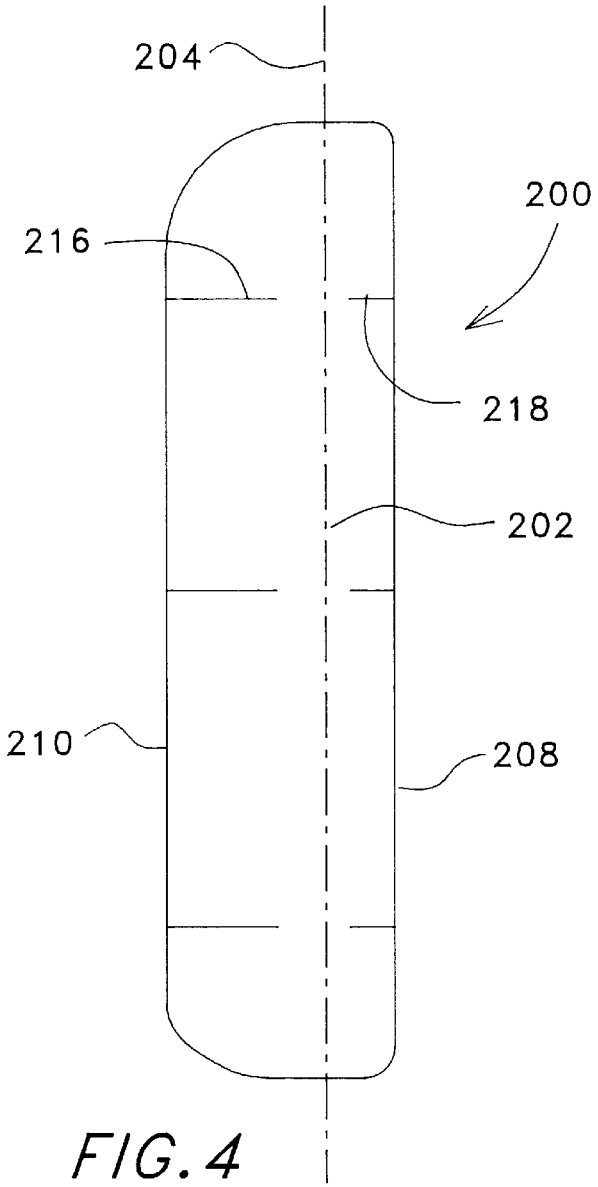
FIG. 4 is a diagrammatic side view of a first embodiment of an aerodynamic fin designed in accordance with the invention for use on a golf club.
Figure 5:
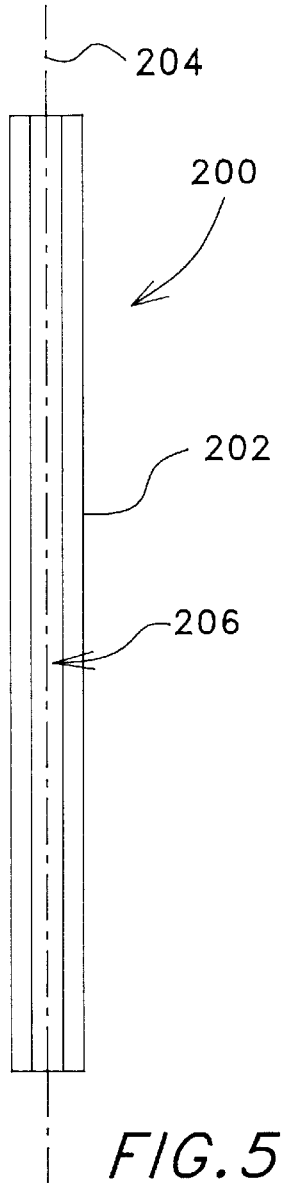
FIG. 5 is a diagrammatic front view of the aerodynamic fin of FIG. 4.
Figure 6:
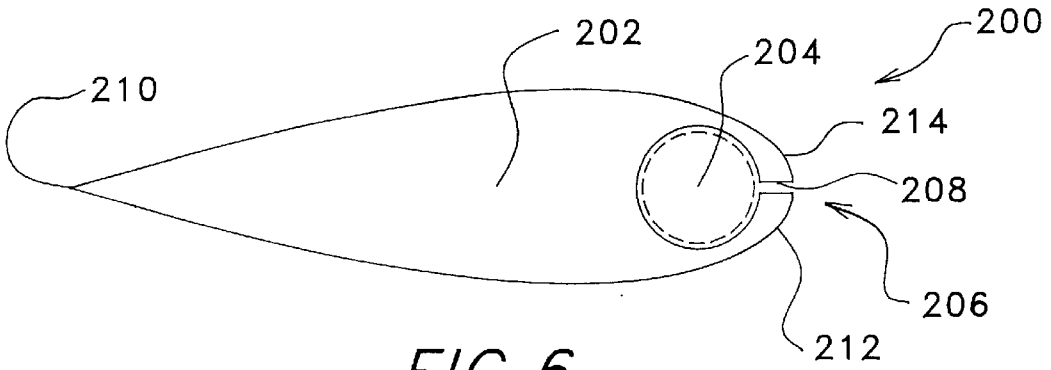
FIG. 6 is a diagrammatic cross sectional view of the aerodynamic fin of FIG. 4.

Referring now to FIGS. 4–6, an aerodynamic fin 200 designed in accordance with the invention will be described. In the embodiment shown, aerodynamic fin 200 is designed for use on a conventional golf club (not shown) having a gulf club grip, a head, and a shaft with a longitudinal axis which extends from the golf club grip to the head of the golf club. Aerodynamic fin 200 includes a main body 202 having a longitudinal axis 204 and an aerodynamic cross-sectional shape extending along longitudinal axis 204 of main body 202. Aerodynamic fin 200 also includes an attaching arrangement 206 for attaching aerodynamic fin 200 to the golf club shaft along the longitudinal axis of the golf club shaft.

In the embodiment shown, aerodynamic fin 200 is configured to extend substantially from the grip of the golf club to the head of the golf club when aerodynamic fin 200 is attached to the golf club. Although aerodynamic fin 200 is described as extending substantially from the grip to the head of the golf club, this is not a requirement. Instead, aerodynamic fin 200 may be any desired length and still remain within the scope of the invention.

As described above for aerodynamic portion 110 of shaft 106, the aerodynamic cross-sectional shape of aerodynamic fin 200 may be any cross sectional shape so long as it provides an improved aerodynamic shape compared to a conventional circular cross sectional shaped golf club shaft. FIGS. 2B–G illustrate some examples of alternative possible aerodynamic cross sections for aerodynamic portion 110. These shapes include, but are not limited to, an elliptical shape, an oval shape, an egg shape, a rectangular shape having rounded corners, a rectangular shape having beveled corners, and an elongated polygon shape all of which are respectively shown in FIGS. 2B–G. Additionally, as described above for aerodynamic portion 110, aerodynamic fin 200 may include a low drag finish such as a polished finish, a smooth painted finish, a waxed finish, a dimpled finish, or a textured finish in order to reduce the aerodynamic drag of the aerodynamic fin.

As illustrated in FIG. 6, aerodynamic fin 200 is shown having a foil cross sectional shape that includes a leading edge 208, defined by the golf club shaft when aerodynamic fin 200 is attached to a golf club, and a trailing edge 210. When aerodynamic fin 200 is properly attached to the golf club using attaching arrangement 206 and in accordance with the invention, aerodynamic fin 200 is oriented such that, compared to a gulf club shaft having a circular cross-sectional shape, the golf club including aerodynamic fin 200 is able to improve the stability of the golf club shaft and head as the golf club is swung through the air to strike a golf ball. That is, when the golf club including aerodynamic fin 200 is swung through a plane generally defined by the plane running through leading edge 208 and trailing edge 210 of aerodynamic fin, the flow of air around aerodynamic fin 200 helps to stabilize the golf club shaft by reducing the vibrations or twisting oscillations in the shaft.

In the embodiment shown, attaching arrangement 206 takes the form of a pair of flanges 212 and 214 formed into the leading edge portion of aerodynamic fin 200. Flanges 212 and 214 extend along the longitudinal length of aerodynamic fin 200 and are formed from a pliable material that allows flanges 212 and 214 to be snapped around the shaft of a golf club. Although attaching arrangement 206 has been described as a pair of flanges that snap fit around the shaft of a golf club, this is not a requirement. Instead, the aerodynamic fin may be attached in any manner so long as it is properly held in position on the golf club shaft. Other attaching arrangements may include using an adhesive material to fix the aerodynamic fin to the golf club, using fasteners to attach the fin to the golf club, or any other conventional attaching arrangement.

As described above for golf club 100, the aerodynamic fin may include slots cut into the trailing edge or leading edge of the aerodynamic fin in order to allow the golf club shaft to more easily flex along the longitudinal axis of the golf club shaft in the plane formed by the leading edge and the trailing edge of the aerodynamic fin when the aerodynamic fin is attached to the golf club. This is illustrated in FIG. 4 by slots 216 and 218.

Figure 7:
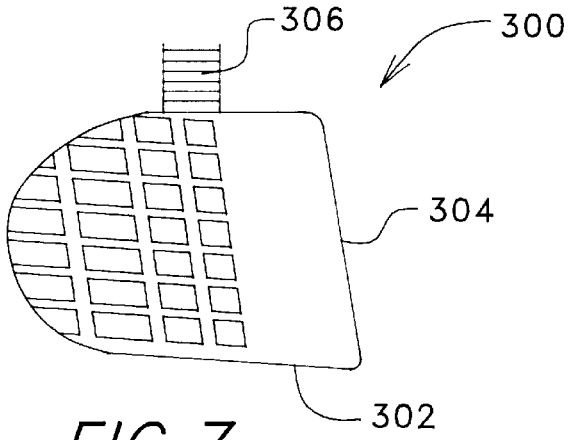
FIG. 7 is a diagrammatic side view of a first embodiment of a golf club head designed in accordance with the invention.
Figure 8:
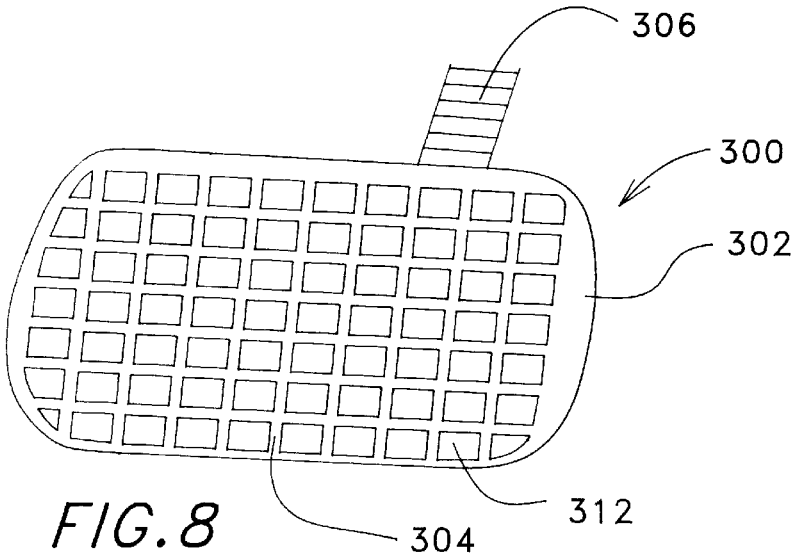
FIG. 8 is a diagrammatic front view of the golf club head of FIG. 7.
Figure 9:
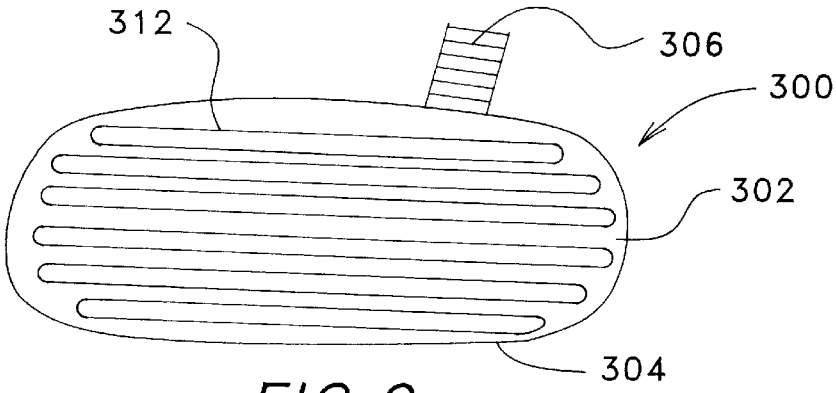
FIG. 9 is a diagrammatic front view of a second embodiment of a golf club head designed in accordance with the invention.

Referring now to FIGS. 7–9, a golf club head 300 designed in accordance with the invention will be described. Golf club head 300 includes an overall aerodynamically shaped main body 302 having a striking surface 304 and an attaching arrangement 306 for attaching the golf club head to a golf club shaft (not shown). In the embodiment shown, attaching arrangement 306 takes the form of a threaded stud protruding from head 300. This stud is threaded into a mating threaded opening on the shaft of a golf club. Although attaching arrangement 306 is shown as being a threaded stud, this is not a requirement of the invention. Instead, attaching arrangement 306 may be any conventional attaching arrangement for attaching a golf club head to a golf club shaft. These other arrangements include, but are not limited to, a connection point to which the shaft of the golf club may be permanently welded, a threaded opening into which a threaded stud on a golf club shaft may be connected, or any other conventional attaching arrangement.

As described above for the previous figures, striking surface 304 of main body 302 of golf club head 300 is oriented such that the striking surface may be used to strike a golf ball when the head is attached to the golf club shaft and the golf club is swung in a certain manner. Striking surface 304 of main body 302 defines an overall striking surface area that is defined by the outer peripheral edge of striking surface 304. In accordance with the invention, golf club head 300 has a plurality of openings 312 formed into striking surface 304 of main body 302. Openings 312 extend all the way through main body 302. In accordance with the invention, this allows air to pass through openings 312 when the golf club is swung in the above described certain manner.

In accordance with the invention, the combined area of openings 312 formed into striking surface 304 is a substantial percentage of the striking surface area of striking surface 304. Preferably, the combine area of openings 312 formed into striking surface 304 is greater than fifty percent of the overall striking surface area. This configuration allows air to flow through openings 312 as head 300 is swung through the air to strike a golf ball. This flow of air through head 300 helps stabilize head 300 and helps prevent the vibration and twisting oscillation problem described above. Also, since air is able to easily pass through head 300, the golf ball is able to more directly contact the portions of the striking surface that engage the golf ball. This reduces the negative effects that may be caused by air that may be trapped between the golf ball and the striking surface of the golf club head during the impact of the striking surface of the head against the golf ball.

In the embodiment shown in FIG. 8, the plurality of openings 312 take the form of a plurality of generally square openings thereby creating a grid pattern on striking surface 304 of main body 302 of golf club head 300. A potential problem with this square shaped openings configuration is that the vertical portions of the grid formed by the square openings may cause sideways forces on the golf ball when the head strikes the golf ball. This potential problem may be reduced by reducing the size and increasing the frequency of openings 312. Alternatively, the plurality of openings may take the form of a plurality of slots expanding through the golf club head as shown in FIG. 9. As shown in FIG. 9, these slots extend horizontally across striking surface 304. This slot configuration eliminates any potential problem of causing a sideways force on the golf ball as described above for the grid pattern embodiment of FIG. 8.

Although only two specific embodiments of openings 312 have been described, openings 312 may be a variety of different shapes and still remain within the scope of the invention. Also, although openings 312 have been illustrated as being evenly distributed over the entire surface area of striking surface 304, this is not a requirement. Instead, openings 312 may be concentrated in any particular portion of striking surface 304 and still remain within the scope of the invention. Furthermore, although the above described embodiments have been describe with the various components having particular respective orientations, it should be understood that the present invention may take on a wide variety of specific configurations with the various components being located in a wide variety of positions and mutual orientations and still remain within the scope of the present invention. Therefore, the present examples are to be considered as illustrative and not restrictive, and the invention is not to be limited to the details given herein, but may be modified within the scope of the appended claims.

What is claimed is:

1. A golf club having a grip and a head, the golf club comprising:

a shaft connecting the grip of the golf club to the head of the golf club, the shaft having a longitudinal axis which extends from the grip of the golf club to the head of the golf club, at least a portion of the shaft having an aerodynamic cross-sectional shape defining an aerodynamic portion of the shaft, the aerodynamic portion of the shaft being oriented along at least a portion of the longitudinal axis of the shaft, and the aerodynamic portion of the shaft being oriented relative to the grip and the head such that, compared to a golf club shaft having a circular cross-sectional shape, the aerodynamic portion of the shaft is able to improve the stability of the shaft as the golf club is swung through the air in a particular manner with the head oriented to squarely strike a golf ball, the aerodynamic portion of the shaft having a leading edge and a trailing edge, the aerodynamic portion of the shaft having at least one slot formed into either the leading edge or the trailing edge of the aerodynamic portion of the shaft in order to allow the shaft to more easily flex along the longitudinal axis of the shaft in the plane formed by the leading edge and the trailing edge of the aerodynamic portion of the shaft, the slot being formed into the one of the edges of the aerodynamic portion of the shaft in a direction that is approximately perpendicular to the plane formed by the leading edge and the trailing edge of the aerodynamic portion of the shaft.

2. A golf club according to claim 1 wherein both the leading edge and the trailing edge of the aerodynamic portion of the shaft have at least one slot formed into both the leading edge and the trailing edge of the aerodynamic portion of the shaft in order to allow the shaft to more easily flex along the longitudinal axis of the shaft in the plane formed by the leading edge and the trailing edge of the aerodynamic portion of the shaft, the slots being formed into the edges of the aerodynamic portion of the shaft in a direction that is approximately perpendicular to the plane formed by the leading edge and the trailing edge of the aerodynamic portion of the shaft.

3. An aerodynamic fin for use on a golf club having a golf club grip, a head, and a shaft with a longitudinal axis which extends from the golf club grip to the head of the golf club, the aerodynamic fin comprising:

a main body having a longitudinal axis and an aerodynamic cross-sectional shape extending along the longitudinal axis of the main body, and an attaching arrangement for attaching the aerodynamic fin to the golf club shaft along the longitudinal axis of the golf club shaft such that the aerodynamic fin is oriented along at least a portion of the longitudinal axis of the shaft and oriented relative to the grip and the head of the golf club such that, compared to a golf club without the aerodynamic fin, the aerodynamic fin is able to improve the stability of the shaft of the golf club as the golf club is swung through the air in a particular manner with the head oriented to squarely strike a golf ball, the aerodynamic fin having a leading edge and a trailing edge, the aerodynamic fin having at least one slot formed into either the leading edge or the trailing edge of the aerodynamic fin in order to allow the golf club shaft to more easily flex along the longitudinal axis of the golf club shaft in the plane formed by the leading edge and the trailing edge of the aerodynamic fin when the aerodynamic fin is attached to the golf club, the slot being formed into the one of the edges of the aerodynamic fin in a direction that is approximately perpendicular to the plane formed by the leading edge and the trailing edge of the aerodynamic fin.

4. An aerodynamic fin according to claim 3 wherein both the leading edge and the trailing edge of the aerodynamic fin have at least one slot formed into both the leading edge and the trailing edge of the aerodynamic fin in order to allow the golf club shaft to more easily flex along the longitudinal axis of the shaft in the plane formed by the leading edge and the trailing edge of the aerodynamic fin when the fin is attached to the golf club shaft, the slots being formed into the edges of the aerodynamic fin in a direction that is approximately perpendicular to the plane formed by the leading edge and the trailing edge of the aerodynamic fin.

* * * * *